United States Patent [19]

Berges

[11] Patent Number: 4,943,215

[45] Date of Patent: Jul. 24, 1990

[54] MULTISTAGE VACUUM PUMP WITH BORE FOR FOULING REMOVAL

[75] Inventor: Hanns-Peter Berges, Cologne, Fed. Rep. of Germany

[73] Assignee: Leybold Aktiengesellschaft, Hanau, Fed. Rep. of Germany

[21] Appl. No.: 313,165

[22] Filed: Feb. 17, 1989

[30] Foreign Application Priority Data

Feb. 29, 1988 [EP] European Pat. Off. ..... 88102986.2
Oct. 25, 1988 [EP] European Pat. Off. ..... 88117706.7

[51] Int. Cl.[5] ..... F04C 18/18; F04C 29/00

[52] U.S. Cl. ..... 418/9; 418/46; 418/270

[58] Field of Search ..... 418/5–11, 418/12–13, 181, 252, 270, 46; 417/434, 572, 244, 250, 251, 252, 254, 266; 55/432, 433

[56] References Cited

U.S. PATENT DOCUMENTS 1,627,024 5/1927 Finch ..... 418/5
3,265,292 8/1966 Schibbye ..... 418/9

FOREIGN PATENT DOCUMENTS 3147824 6/1982 Fed. Rep. of Germany .
3244099 6/1983 Fed. Rep. of Germany .

*Primary Examiner*—John J. Vrablik
*Assistant Examiner*—David L. Cavanaugh
*Attorney, Agent, or Firm*—Felfe & Lynch

[57] ABSTRACT

A multistage vacuum pump with a case with at least two pump chambers in the case, and with at least one passage connecting the pump chambers together. To detect fouling in the especially sensitive connecting passages in a simple manner, it is proposed to configure the passages as part of bores leading to the outside, which can be closed with a plug.

9 Claims, 3 Drawing Sheets

MULTISTAGE VACUUM PUMP WITH BORE FOR FOULING REMOVAL

The invention relates to a multistage vacuum pump having a housing, at least two pump chambers in the housing, and a passage connecting the pump chambers together.

Multistage vacuum pumps are disclosed in DE-OS 31 47 824 and in DE-OS 32 44 099. If pumps of this or of a similar kind are used for the evacuation of chambers in which etching, coating or other vacuum treatment or manufacturing processes are performed, it often happens that solids get into the pump. The possibility even exists that such solids are formed during the compression of the gases, i.e., while the gases being pumped out pass through the vacuum pump. Examples are the formation of aluminum chloride in the etching of aluminum, ammonium chloride in coating processes, etc.

If substances of this kind accumulate in the passages through which the gas being evacuated passes, the diameter of these passages is narrowed, resulting in an impairment of the performance of the vacuum pump. When incipient fouling of detected, disassembly of the pump is required, which is complicated and therefore expensive.

It is an object of the present invention to provide a vacuum pump of the kind described, in which the detection of fouling of passages is especially simple.

This object is accomplished in accordance with the invention in that the passage subject to fouling is a portion of a bore leading outward, which can be closed with a plug. This solution makes it possible to inspect the connecting passage or passages without disassembling the pump. When the plug is removed the connecting passage is accessible, for the introduction of an endoscope, for example.

The plug is best provided with a longitudinal bore to which a section of tubing provided with a flange is attached. Pressure or temperature sensors, for example, can be introduced through the flange into the interior or the connecting passage in a vacuum-tight manner, so that these parameters can be monitored during operation.

In another advantageous solution, a sleeve is inserted into the bore which forms at least a part of the inner wall of the passage. The sleeve in which the solids deposit can be removed through the mouth of the bore and can either be cleaned or replaced with a new one. The cleaning of critical areas of passages is thus especially simple.

In accordance with the invention, a multistage vacuum pump comprises a case and at least two pump chambers in the case. The pump includes at least one passage in the case and connecting the pump chambers together. The pump also includes a bore in the case leading outwards and including the passage. The pump also includes a plug for closing the bore.

For a better understanding of the invention, together with other and further objects thereof, reference is made to the following description, taken in connection with the accompanying drawings, and its scope will be pointed out in the appended claims.

Referring now to the drawings.

Figure 4:
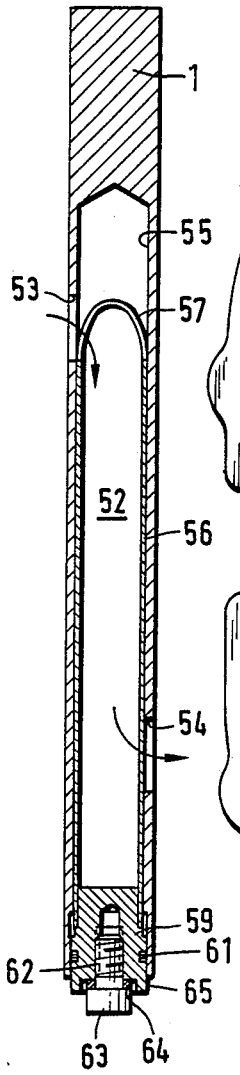
Figure 3:
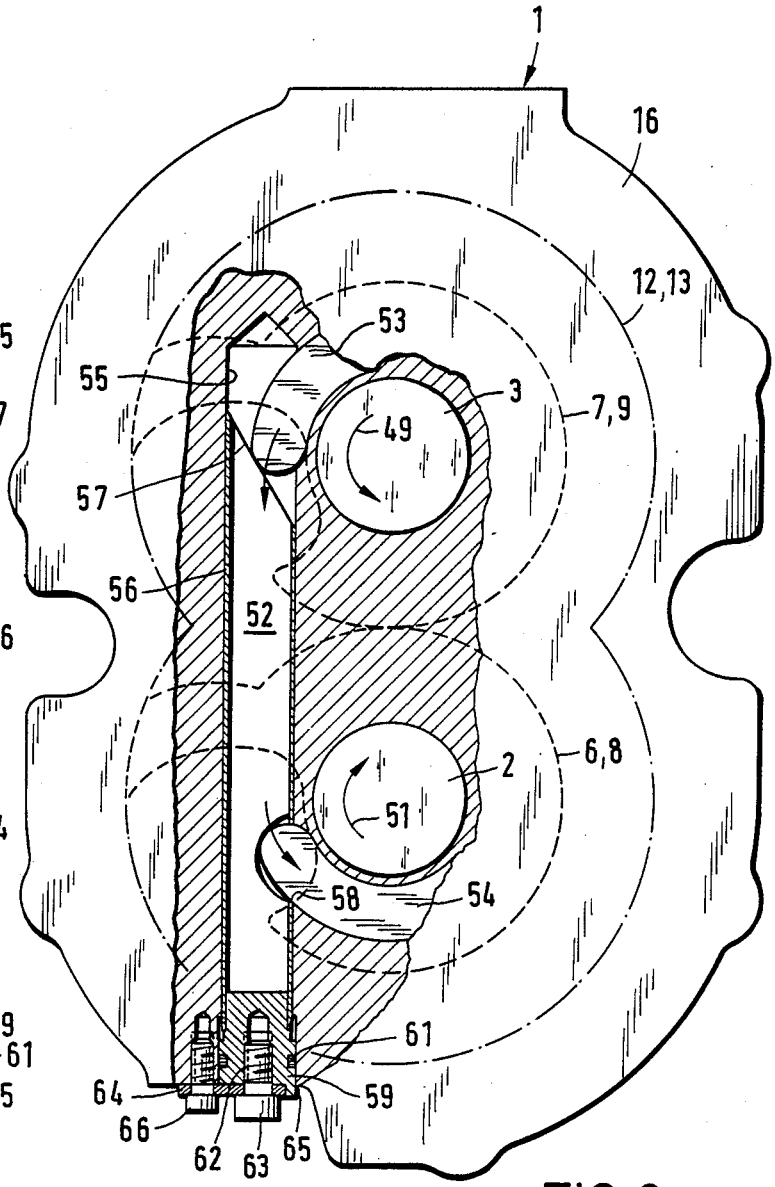
Figures 5, 6:
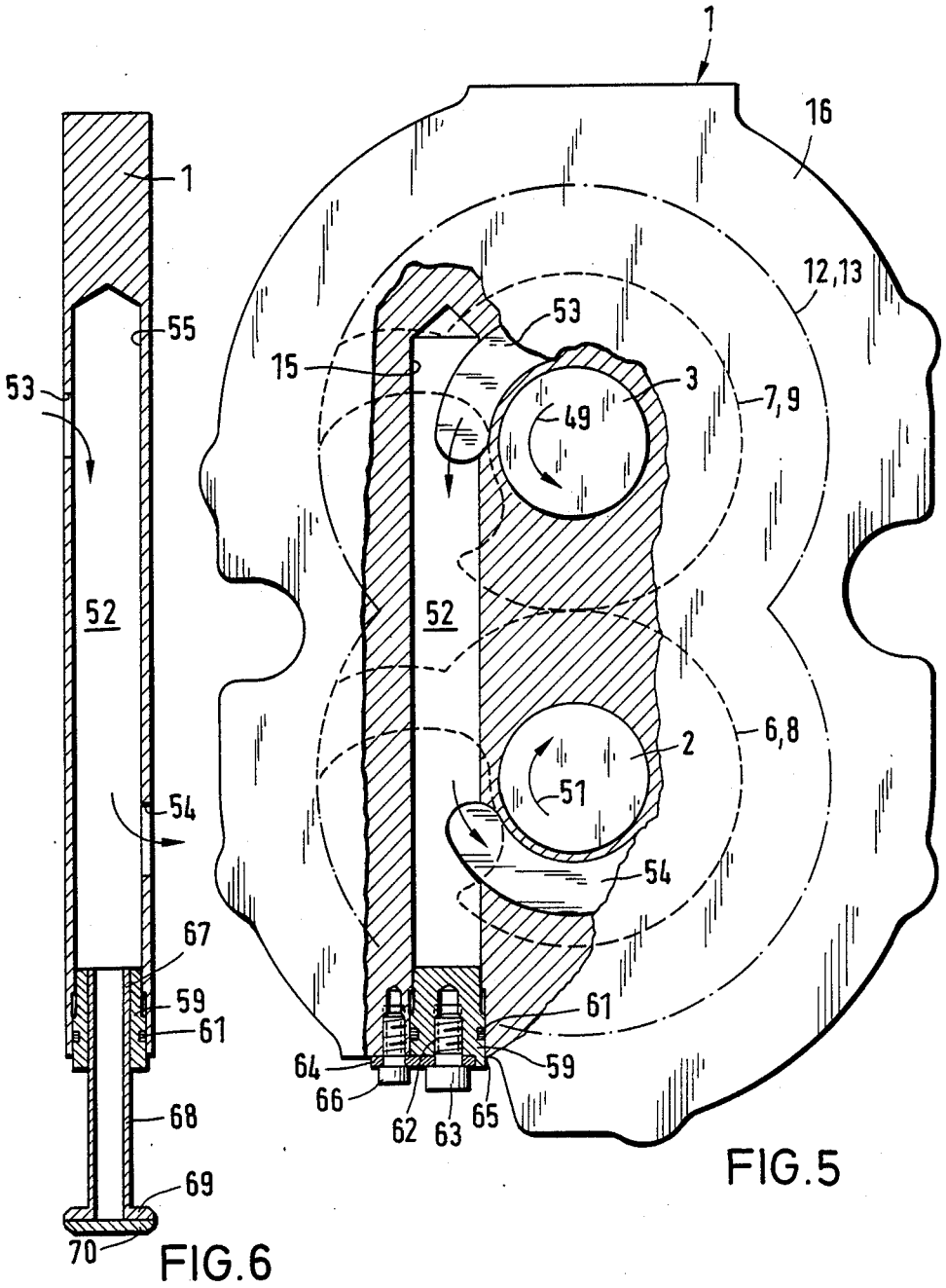

FIGS. 3 and 5 each is a view, partly in section, through a multistage pump of the claw type, perpendicular to the axis of rotation of the rotors; and FIGS. 4 and 6 each is a view in section perpendicular to the sections in FIGS. 3 and 5, respectively, through a side wall.

Figure 1:
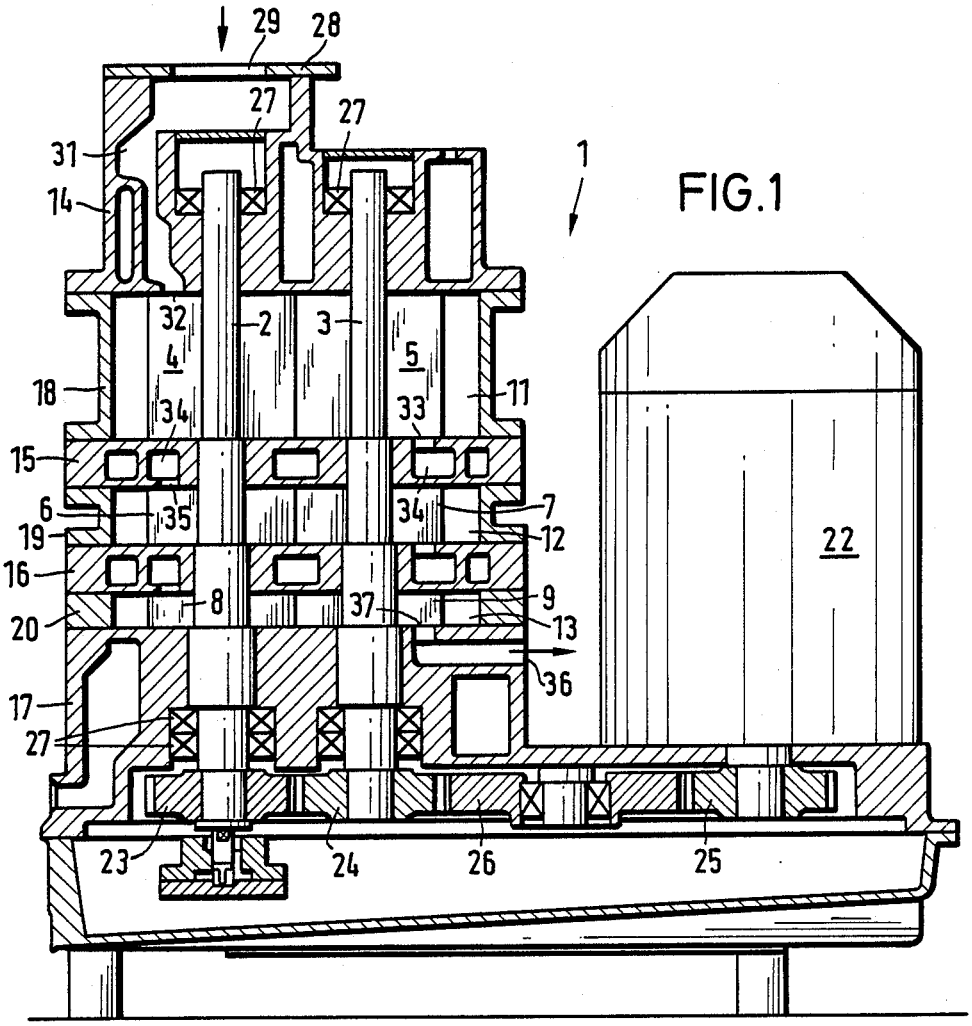
FIG. 1 is a view in longitudinal section through a multistage pump in accordance with the invention with pump case and motor arranged side by side.
Figure 2:
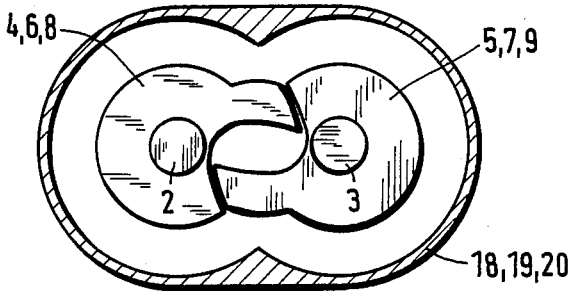
FIG. 2 is a view in section through a pair of rotors.

Referring now more particularly to the drawings, the embodiment represented in FIG. 1 is a three-stage vacuum pump 1 with two shafts 2 and 3, and three pairs of rotors, 4–5, 6–7 and 8–9. The axial length of the rotors decreases from the suction side to the discharge side. The rotary pistons are of the claw type (cf. FIG. 2) and rotate in the pump chambers 11, 12 and 13, which are formed by the plates 14 to 17 and the case rings 18 to 20.

The shafts 2 and 3 are vertically disposed. This is also true of the motor 22 disposed alongside the pump case. Underneath the bearing plate 17 the shafts 2 and 3 are equipped with gears 23 and 24 of equal diameter which serve to synchronize the movement of the rotor pairs 4–5, 6–7 and 8–9. Also the motor 22 has a gear 25 on its bottom. The driving connection is provided by an additional gear 26 which meshes with gears 24 and 25.

In the upper bearing plate 14 and lower bearing plate 17 the shafts 2 and 3 are supported on ball bearings 27. The upper bearing plate 14 is equipped with a horizontally disposed flange 28 which forms the inlet 29 of the pump. The inlet passage 31 leads at the end (opening 32) into the pump chamber 11 of the first stage. The outlet opening of the first stage, disposed at the end, is marked 33 and leads into the connecting passage 34. The connecting passage 34 situated in the plate 15 is in communication with the inlet opening 35 of the second stage. The bearing plate 16 is configured accordingly. Under the lowermost (third) pump stage is the outlet 36 which is in communication with the end outlet opening 37 in the bottom bearing plate 17.

The plate 16 represented in FIGS. 3 to 6 serves to separate two pump chambers 12 and 13 of the claw pump 1. Referring to the manner of representation chosen in FIG. 1, one pump chamber 12 is above plate 16 and the second pump chamber 13 is below plate 16. The contour of the pump chambers 12 and 13 is represented in dash-dotted lines in FIGS. 3 and 5. One rotor pair 6–7 and 8–9 is situated in each of these pumping chambers, the rotors being represented in broken lines. The shafts 2 and 3 carrying the rotors pass through plate 16. Their direction of rotation is indicated by arrows 49 and 51.

The passage 52 is provided to enable the pumped medium to pass from the high-vacuum stage with the pump chamber 12 above the plate 16 to the pre-vacuum stage with the pump chamber 13 under the plate. It connects the outlet 53 of pump chamber 12 to the inlet 54 of pump chamber 13. Outlet 53 and inlet 54 are formed by arcuate openings in the plate 16.

The passage 52 is formed by a blind bore 55 in plate 16, which intersects outlet 53 and inlet 54 and thus connects them together. In the embodiments in FIGS. 3 and 4, a sleeve 56 is introduced into bore 55 to form the inner wall of the passage 52, especially in the area of the section that connects outlet 53 and inlet 54. Outlet 53 is associated with the slanted inner end 57 of sleeve 56, while an opening 58 in the sleeve is associated with the inlet 54.

The outer end of sleeve 56 is equipped with a plug 59. Sleeve 56 and plug 59 are welded together. One purpose of plug 59 is to seal up the mouth of the blind bore 55. For this purpose it is equipped with the O-ring 61.

The plug also has a thread 62 which is accessible from the exterior. This thread accommodates a screw 63 by which a latch 64 is fastened on the plug 59. To give the latch 64 a definite position on the plug 59, the plug 59 is provided with the rim 65. The latch 64 is fastened to plate 16 by means of another screw 66.

If during the operation of the pump 1 fouling with solids occurs, the solids will deposit themselves preferentially in the passage 52. To clean them out, it will suffice, as a rule, to loosen the screw 66, pull out the sleeve 56 and clean it, or replace it with a fresh one. If the sleeve cannot easily be extracted, then it will be possible also to take out the screw 63 and insert into the thread 62 a tool by means of which seized sleeves can be loosened and removed by the application of greater force. After cleaning, the latch 64 with screw 63 is fastened back on the plug 59. The cleaned sleeve 56 is inserted into the bore 55. Then the latch 64 is fastened by screw 66 on the plate 16. The position of this screw and the rim 65 on plug 59 assure the correct position of the sleeve 56 in bore 55, i.e., that the slanted end 57 of the sleeve 56 will be associated with outlet 53 and the opening 58 with the inlet 54.

FIGS. 5 and 6 show embodiments in which, as in the other embodiments, the connecting passage 52 is part of a bore 55 in the plate 16 which leads to the outside. Bore 55 is closed with the plug 59. After plug 59 is removed, the connecting passage 52 is open for inspection, e.g., by means of an endoscope, without the need for disassembly.

FIG. 6 shows an embodiment in which the plug 59 is provided with a longitudinal bore 67 in which a tube section 68 preferably is situated and affixed. The outer end of tube section 68 is provided with a blind flange 69 on which a cap 70 is hermetically sealed. Instead of the blind flange 70, mountings can be hermetically sealed to accommodate sensors introduced into the connecting passage 52.

While there have been described what are at present considered to be the preferred embodiments of this invention, it will be obvious to those skilled in the art that various changes and modifications may be made therein without departing from the invention, and it is, therefore, aimed to cover all such changes and modifications as fall within the true spirit and scope of the invention.

What is claimed is:

1. A multistage vacuum pump comprising:

a case;

at least two pump chambers in the case;

at least one passage in the case and connecting the pump chambers together;

a bore in the case leading outwards and including the passage; and a plug for closing the bore, the plug including the longitudinal bore having an outer end, a tube section at the outer end of the bore, and a flange on the tube section.

2. A pump in accordance with claim 1, in which the pug is affixed to the tube section.

3. A multistage vacuum pump comprising:

a case;

at least two pump chambers in the case;

at least one passage in the case and connecting the pump chambers together;

a bore in the case leading outwards and including the passage;

a plug for closing the bore; and a sleeve fastened to the plug and forming at least a part of the inner wall of the connecting passage.

4. A pump in accordance with claim 1, in which the sleeve has openings which serve for the entry and exit of a medium flowing through the connecting passage.

5. A pump in accordance with claim 1, in which the sleeve has a slanted inner end.

6. A pump in accordance with claim 3, in which the plug has a screw thread.

7. A pump in accordance with claim 3, in which the pump chambers are separated from one another by a plate in which the bore including the connecting passage is situated and which includes a latch disposed on the plug and releasably fastened to the plate.

8. A pump in accordance with claim 7, in which the plug includes an abutment or rim associated with the latch to fix the position of the plug.

9. A pump in accordance with claim 3, in which the plug is affixed to the sleeve.

* * * * *

UNITED STATES PATENT AND TRADEMARK OFFICE

CERTIFICATE OF CORRECTION

PATENT NO. : 4,943,215

DATED : July 24, 1990

INVENTOR(S) : Hanns-Peter Berges

It is certified that error appears in the above-identified patent and that said Letters Patent is hereby corrected as shown below:

Column 4, line 16 for "pug" read -- plug --.

Signed and Sealed this

Second Day of June, 1992

*Attest:*

DOUGLAS B. COMER

*Attesting Officer*

*Acting Commissioner of Patents and Trademarks*